United States Patent [19]

Martin

[11] Patent Number: 4,689,456

[45] Date of Patent: Aug. 25, 1987

[54] KEY SWITCH HAVING COOPERABLE CAMS WHICH TRANSLATE ROTARY MOTION TO RECTILINEAR

[75] Inventor: Adolf H. Martin, Glenview, Ill.

[73] Assignee: Adams Elevator Equipment Company, Skokie, Ill.

[21] Appl. No.: 857,678

[22] Filed: Apr. 30, 1986

[51] Int. Cl.[4] ..... H01H 27/06

[52] U.S. Cl. ..... 200/43.08; 200/336

[58] Field of Search ..... 200/43.08, 43.13, 336

[56] References Cited

U.S. PATENT DOCUMENTS 2,803,716 8/1957 Nolden et al. ..... 200/43.08

4,504,713 3/1985 Hennessey ..... 200/241

FOREIGN PATENT DOCUMENTS 3219027 12/1982 Fed. Rep. of Germany ... 200/43.08

*Primary Examiner*—Stephen Marcus

*Assistant Examiner*—Renee S. Luebke

*Attorney, Agent, or Firm*—D. R. Lackey

[57] ABSTRACT

A two-position key switch of modular construction including an electrical contact module, a lock module, and a halo module, with the lock module being mounted in the halo module to provide a subassembly which is fixed to the electrical contact module. First and second cam members respectively associated with the electrical contact module and the lock module translate rotary motion of a rotary core of the lock module to rectilinear motion of an actuator element of the electrical contact module.

8 Claims, 12 Drawing Figures

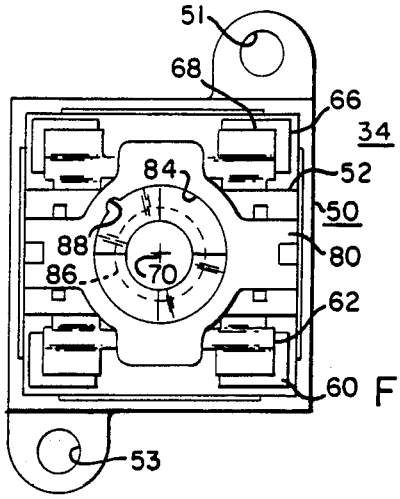
FIG. 5
FIG. 6
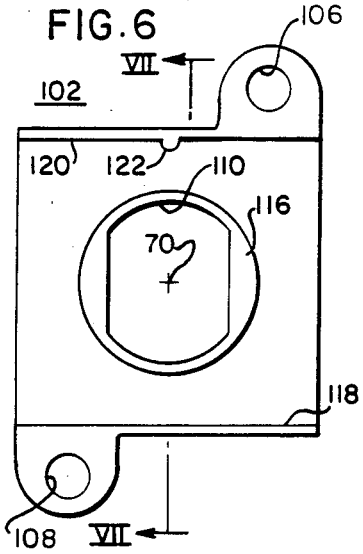
FIG. 7
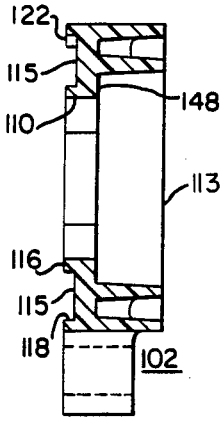
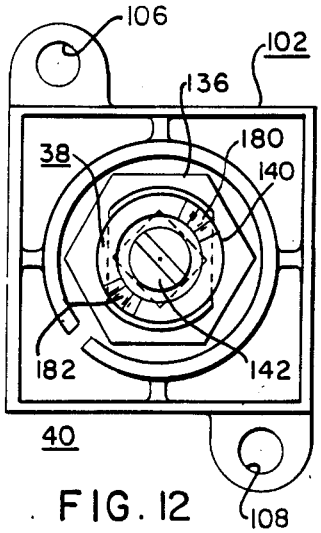
FIG. 12
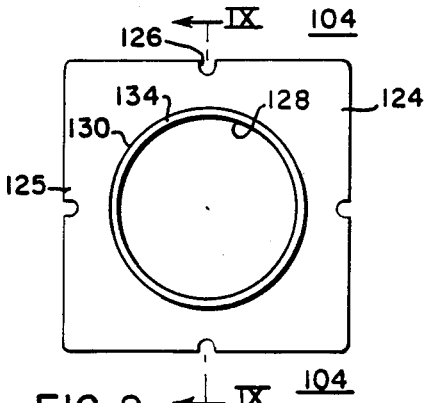
FIG. 8
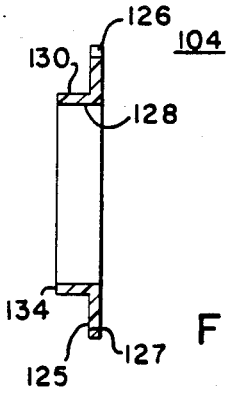
FIG. 9

KEY SWITCH HAVING COOPERABLE CAMS WHICH TRANSLATE ROTARY MOTION TO RECTILINEAR

BACKGROUND OF THE INVENTION

1. Field of the Invention

The invention relates in general to electrical switches, and more specifically to key operated electrical switches.

2. Description of the Prior Art

U.S. Pat. No. 4,504,713, which is assigned to the same assignee as the present application, discloses a new and improved push button electrical switch assembly which includes an actuator biased for resilient reciprocation between axial limits within a housing. A cover on the housing includes a push button movable between predetermined axial limits. Many applications require a two-position electrical switch which is actuatable only by a key. The key, which is used to select one of the two positions, may be removable in one, or both positions, as desired, depending upon the specific application. When the other position of the switch is desired, the key is again inserted to select it.

It would be desirable to be able to easily convert the switch of the aforesaid patent to a two-position key switch, utilizing any one of a large number of key locks, while utilizing a few standard modules.

SUMMARY OF THE INVENTION

Briefly, the present invention is a new and improved two-position key switch of modular construction which utilizes only three basic modules, an electrical contact module, a lock module, and a halo module. The electrical contact module may include the housing and actuator of the hereinbefore mentioned U.S. Pat. No. 4,504,713, modified to include a first cam member which is keyed within a recess defined by the actuator. The lock module may be any rotatable type lock assembly modified to include a second cam member at the end of the lock core which is opposite to the key end of the lock core. The cover and push button of U.S. Pat. No. 4,504,713 have been replaced by a halo module which includes a key switch halo adapter, or cover, which is configured to receive a snap-in halo which includes legends for identifying the two positions of the key switch. The lock module is attached to the key switch halo adapter of the halo module to provide a subassembly which is coupled with the electrical contact module and held in assembled relation by a pair of studs which extend outwardly from the back side of a panel which the key switch is to be associated with. The second cam member extends into the actuator recess, with the first and second cam members being configured to cooperatively translate rotary motion of the lock core to rectilinear motion of the actuator, to move the actuator between its axial limits and provide the electrical contact positions associated with these limits.

BRIEF DESCRIPTION OF THE DRAWINGS

The invention may be better understood, and further advantages and uses thereof more readily apparent, when considered in view of the following detail description of exemplary embodiments, taken with the accompanying drawings in which:

FIG. 5 is an end view of the electrical contact module shown in FIG. 2, illustrating the first cam member keyed within the recess of an actuator associated with the electrical contact module;

FIG. 6 is an end view of the halo adapter portion of the halo module shown in FIG. 2;

FIG. 7 is a cross-sectional view of the halo adapter shown in FIG. 6, taken between and in the direction of arrows VII—VII in FIG. 6;

FIG. 8 is an end view of the halo portion of the halo module shown in FIG. 2;

FIG. 9 is a cross-sectional view of the halo shown in FIG. 8, taken between and in the direction of arrows IX—IX in FIG. 8;

FIG. 12 is an end view of the halo module shown in FIG. 2 assembled with the lock module to provide a subassembly, with the illustrated end of the subassembly mating with the illustrated end of the electrical contact module shown in FIG. 5, to complete assembly of the two-position key switch.

DESCRIPTION OF PREFERRED EMBODIMENTS

Figure 1:
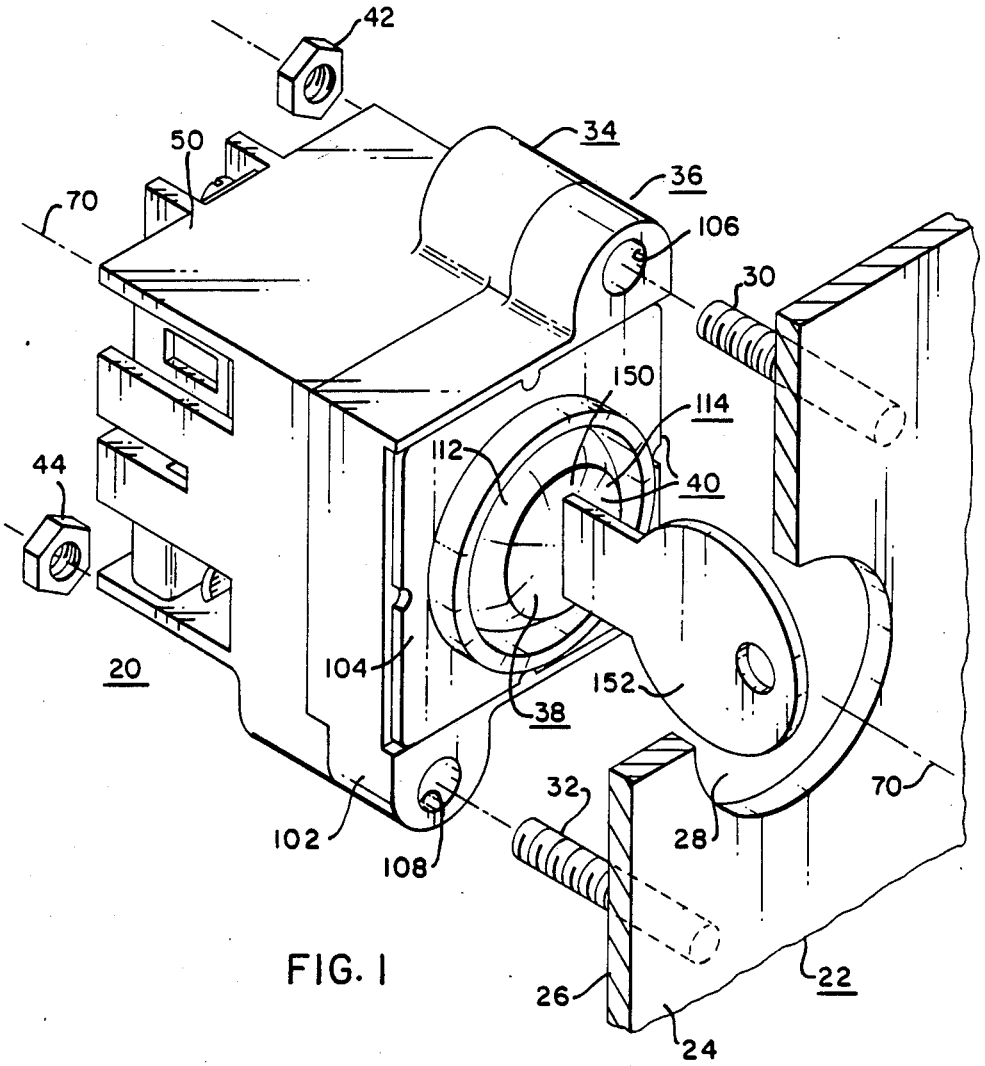
FIG. 1 is a perspective view of a two-position key switch constructed according to the teachings of the invention.

Referring now to the drawings, and to FIG. 1 in particular, there is shown a perspective view of a two-position key switch 20 constructed according to the teachings of the invention. Key switch 20 is adapted for mounting in a panel 22 having front and rear sides or surfaces 24 and 26, respectively, an opening 28 which extends between sides 24 and 26, and first and second stud members 30 and 32 which are fixed to, and extend perpendicularly outward from, the rear side 26 of panel 22.

Figure 2:
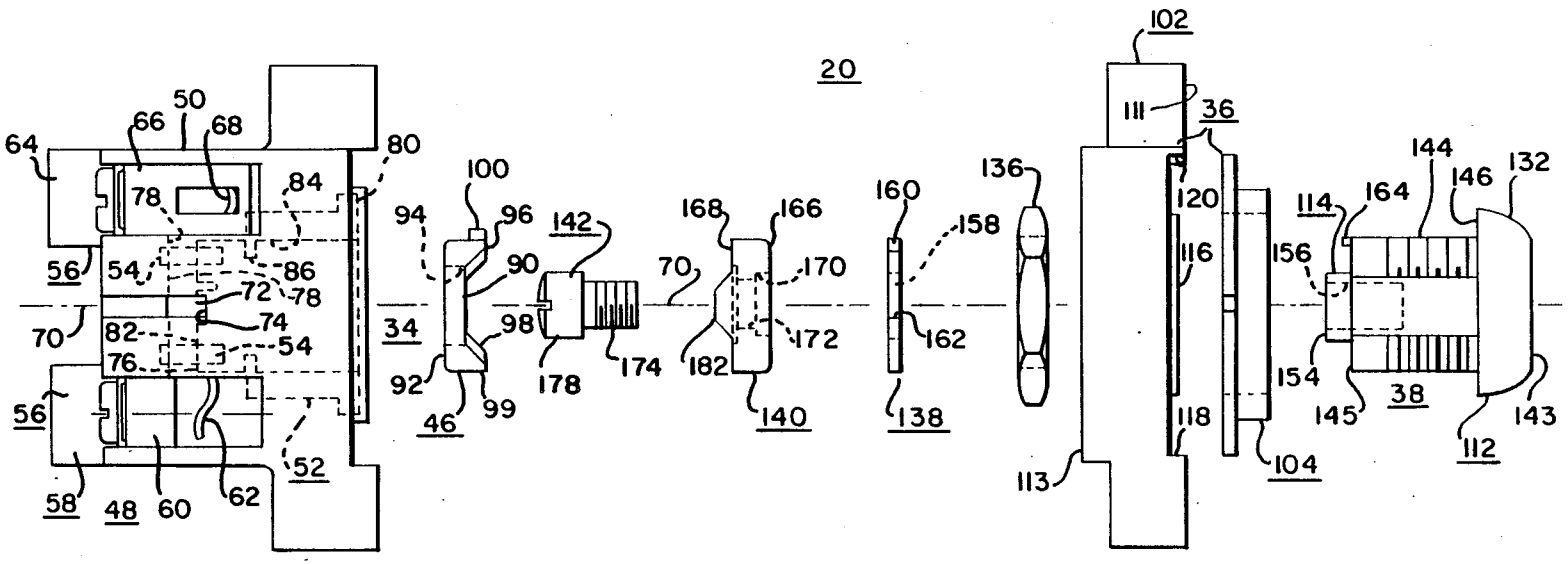
FIG. 2 is an exploded elevational view of the two-position key switch shown in FIG. 1, illustrating the various elements of a halo module, a lock module, and an electrical contact module.
Figure 3:
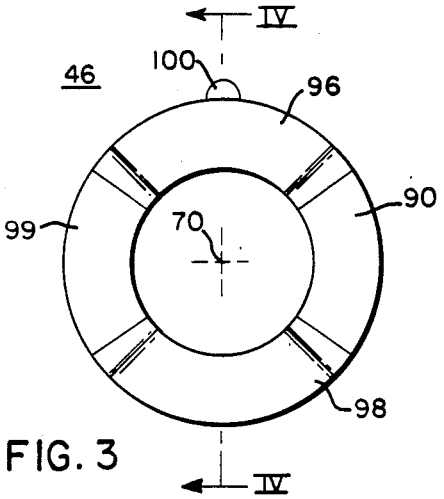
FIG. 3 is a view of the cam lobe side of a first cam member, which cam member is associated with the electrical contact module shown in FIG. 2.
Figure 4:
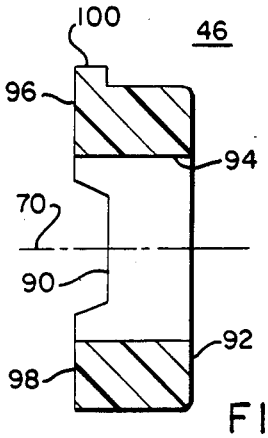
FIG. 4 is a cross-sectional view of the first cam member shown in FIG. 3, taken between and in the direction of arrows IV—IV in FIG. 3.

Key switch 20 is of modular construction, including an electrical contact module 34, a halo module 36, and a lock module 38. Lock module 38 is assembled with halo module 36 to provide a subassembly 40 which is held in assembled relation with the contact module 34 by studs 30 and 32, and nuts 42 and 44. FIG. 2 is an exploded, side elevational view of key switch 20, which more clearly illustrates the various elements of the three modules. The electrical contact module 34 includes a first cam member 46, which is also shown in FIGS. 3, 4 and 5, and an electrical contact assembly 48. Electrical contact module 34 is also shown in FIG. 5. The electrical contact assembly 48 may be the electrical contact assembly shown in detail in the hereinbefore mentioned U.S. Pat. No. 4,504,713, which is hereby incorporated into the present application by reference.

More specifically, the electrical contact assembly 48 includes a housing 50 having stud receiving openings 51 and 53, an actuator 52, biasing means 54, such as helical compression springs, and electrical contact means 56. The electrical contact means 56 may have two normally open contacts, two normally closed contacts, or one of each. For purposes of example, electrical contact means 56 is illustrated with one of each, having a normally open contact 58 which includes a stationary contact 60 fixed to housing 50 and a movable contact 62 carried by actuator 52, and a normally closed contact 64 which includes a stationary contact 66 fixed to housing 50 and a movable contact 68 carried by actuator 52.

As described more fully in the incorporated patent, actuator 52 is mounted for guided rectilinear motion within housing 50, along a longitudinal centerline or axis 70, via cooperative ribs and grooves. Bias means 54 is disposed between housing 50 and actuator 52, biasing the actuator 52 towards a first axial limit established by a leg portion 72 of actuator 52 contacting surface 74 of housing 50. A second axial limit, which is reached by overcoming the bias of the bias means 54, is provided when surface 76 of actuator 52 contacts surface 78 of housing 50.

Actuator 52 has first and second axial ends 80 and 82, respectively, and a recess or opening 84 which extends between its ends. Opening 84 is open at the first axial end 80, and at least partially closed at its second axial end, such as by an inwardly extending flange 86. The only modification required to the electrical contact assembly 48 of the incorporated patent is a longitudinally extending groove 88 in the surface which defines recess or opening 84, as shown most clearly in FIG. 5 which is an end view of the electrical contact module 34.

Electrical contact module 34 additionally includes the first cam member 46 shown in FIG. 2. Cam member 46 is preferably formed of a plastic material having excellent strength and wear characteristics, such as Nylon 6/6. Cam member 46 has first and second axial ends 90 and 92, respectively, an opening 94 which extends between ends 90 and 92, and first and second oppositely disposed cam lobes 96 and 98, respectively, which extend outwardly from the first axial end 90. As best shown in FIG. 3, which is a view of the cam lobe side of cam member 46, cam member 46 has a round or cylindrical outer surface 99 sized to snugly but slidably fit the diameter of recess 84 in actuator 52. In order to orient cam lobes 96 and 98, as well as to prevent cam member from rotating from the oriented position, a longitudinally extending key 100 extends outwardly from surface 99, which key is configured to cooperate with groove 88 in recess 84. The high sides of the cam lobes 96 and 98 are in the first and third quadrants, each occupying 90 degrees, and in the illustrated embodiment, the locating key 100 is centrally positioned relative to cam lobe 96. Cam member 46 is slidably advanced into recess 84 until the second axial end 92 of cam member 46 contacts flange 86, which then completes the electrical contact module 34. While the invention advantageously utilizes the electrical contact assembly 48 of the incorporated patent, it is to be understood that other electrical contact assemblies having the same general features may be used.

The cover and push button of the incorporated patent have been replaced in the present invention by subassembly 40 which includes the halo module 36 and the lock module 38. Specifically, the halo module 36 replaces the cover utilized in the incorporated patent, and the lock module 38 replaces the push button. The halo module 36 shown in FIG. 2 includes a key switch halo adapter 102 which functions as a cover for the electrical contact module 34, and a halo 104. The halo adapter 102 is also shown in an end view in FIG. 6, and in a sectional view in FIG. 7, with FIG. 7 being taken between and in the direction of arrows VII—VII in FIG. 6.

More specifically, halo adapter 102, which is formed of a high strength plastic, such as a polycarbonate, includes stud receiving openings 106 and 108, which are respectively aligned with stud receiving openings 51 and 53 of the electrical contact module 34, when subassembly 40 is assembled with the electrical contact module 34. Halo adapter 102 also includes a central, longitudinally extending opening 110 coaxial with centerline 70, which extends between first and second axial ends 111 and 113 of the halo adapter 102. Opening 110 is configured to snugly receive the lock module 38, and to prevent the stationary portion or lock case 112 of the lock module 38 from rotating, when the rotatable portion or lock core 114 is rotated about longitudinal axis 70.

The first axial end 111 of halo adapter 102 is recessed slightly to provide a recess 115, best shown in FIG. 7, which recess is defined by a round protuberance 116 about opening 110, and by upper and lower flanges 120 and 118, respectively. A centrally disposed locating key 122 extends into the recess 115 from flange 120.

Halo 104, shown in a front elevational view in FIG. 8, and in a cross-sectional view in FIG. 9, with FIG. 9 being taken between and in the direction of arrows IX—IX in FIG. 8, is formed of a plastic, such as a polycarbonate, or a metal, such as anodized aluminum. Halo 104 includes a thin plate member 124 having first and second major sides or surfaces 125 and 127, respectively. The thickness dimension of plate member 124 between its major surfaces 125 and 127 is selected to be substantially equal to the depth of recess 115 in the halo adapter 102. Plate member 124 has a square outer configuration dimensioned to provide a slight interference fit between flanges 118 and 120 of the halo adapter 102, with each side of the square configuration having a centrally located depression, such as depression 126. Plate member 124 includes a central opening 128 which proceeds through the plate member 124, and which is further defined by a cylindrical, tubular projection 130 which extends outwardly from one major side of plate 124. Projection 130 is configured and dimensioned to match the panel opening it is to be associated with. For example, it may be cyindrical, as shown, square, or any other configuration. The diameter of opening 128 is selected to accept the larger end portion 132 of the lock case 112, and the outside configuration and length of the projection 130 are dimensioned to cause the projection to snugly extend into opening 28 of panel 22, and to smoothly continue the flat front surface 24 of panel 22. The outermost end 134 of projection 130, which is aligned with surface 24 of panel 22, may also have legends inscribed thereon to indicate the two positions of the key switch 20, such as the legends "on" and "off." Halo 104, being a slight interference fit with recess 115 of the halo adapter 102, easily snaps into the recess 115, accurately centered by key 122 and depression or groove 126. Halo 104 may be provided in different colors and with different legends, to make key switch 20 adaptable to virtually any application.

The lock module 38 may utilize any one of a wide variety of locks which are actuated by a key and rotary motion. The lock module 38 shown in FIG. 2 is typical, having a stationary lock case 112 and a rotatable lock core 114. The lock module 38 further includes a nut 136, a stop washer 138, a cam member 140, and a screw 142. The lock case 112 has first and second axial ends 143 and 145, the hereinbefore mentioned larger end portion 132, which is at the first axial end 143, and a threaded shank portion 144 which extends from a flange 146 to the second axial end 145. Flange 146 is created by the interface between the enlarged end portion 132 and the threaded shank portion 144.

In forming the subassembly 40, the threaded shank end 144 of the lock case 112 is disposed through opening 110 of the halo adapter 102, with the flange 146 of the lock case 112 disposed against protuberance 116. Nut 136 is then threadably engaged with the shank end 144, until nut 136 snugs against surface 148 of the halo adapter 102, which surface is best shown in FIG. 7.

The rotatable lock core 114 has a first axial end 150 which receives an operating key 152, as shown in FIG. 1, and a second axial end 154. The second axial end 154 has a square cross-sectional configuration, and a tapped, centrally disposed opening 156 which extends inwardly from the second axial end 154. The stop washer 138 has an opening 158 sized to be pressed over the square second axial end 154 of the lock core 114, until it rests against the second axial end 145 of the lock case 112. The outer periphery of stop washer 138 is recessed for a predetermined number of degrees to provide stops 160 and 162 which cooperate with an extension 164 at the second axial end 145 of the lock case 112, to positively define the rotatable limits of the lock core 114 to a predetermined angle, such as 90 degrees.

Figure 10:
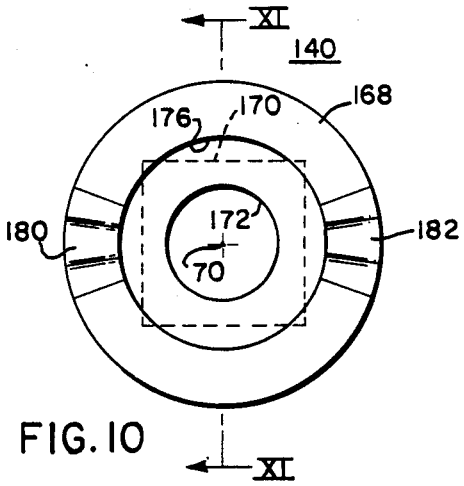
FIG. 10 is a view of the cam lobe side of a second cam member, which cam member is associated with the lock module shown in FIG. 2.
Figure 11:
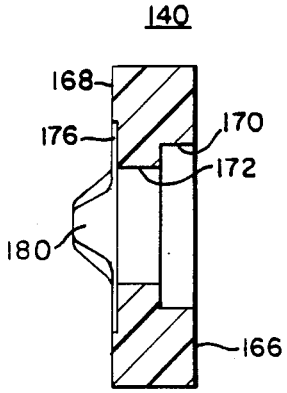
FIG. 11 is a cross-sectional view of the second cam member shown in FIG. 10, taken between and in the direction of arrows XI—XI in FIG. 10.

Cam 140, which may be called the second cam member when cam 46 is referred to as the first cam member, is also shown in a front elevational view in FIG. 10, and in a cross-sectional view in FIG. 11. Cam 140 is preferably formed of the same material as cam 46, such as Nylon 6/6. FIG. 11 is taken between and in the direction of arrows XI—XI in FIG. 10. Cam 140 has first and second axial ends 166 and 168, respectively, and a stepped opening which extends between its ends, including an opening 170 which starts at the first axial end 166. Opening 170 has a square configuration in cross-section, sized to receive the second axial end 154 of the lock core 114. The stepped opening through cam member 140 also has a round opening 172 sized to receive the threaded shank portion 174 of screw 142. The second axial end 168 is recessed slightly about opening 172, as indicated at 176, to snugly receive the diameter of the head portion 178 of screw 142. The non-recessed portion of the second axial end 168 has first and second oppositely disposed cam lobes 180 and 182. Cam lobes 180 and 182 are aligned relative to the square opening 170. For example, a line drawn through the central axis 70 which is perpendicular to two sides of the square opening may bisect each of the cam lobes 180 and 182. Cam lobes 96 and 98 of the first cam member 46 define the angular engagement of the first and second cam members 46 and 140. Thus, cam lobes 180 and 182 may be at their peak dimension for a relatively short distance, as best illustrated in FIGS. 2 and 11.

Subassembly 40 is completed by pressing stop washer 138 over the square second axial end 154 of the lock core 114, until it contacts the second axial end 145 of the lock case 112, by placing the second cam member 140 on the second axial end 154 of the lock core 114 such that the square end 154 enters the square opening 170 of cam member 140, and by threadably engaging screw 142 with the tapped opening 156 in the second axial end 154 of the lock core 114 to hold the second cam member 140 in the desired position relative to the lock core 114. Cam member 140 has cam lobes 180 and 182 oriented to engage cam lobes 96 and 98 of cam member 46 in the desired rotary position of the lock core 114.

FIG. 1 illustrates the end of subassembly 40 which has a portion which extends into opening 28 of panel 22, and FIG. 12 is an elevational view which illustrates the opposite end of subassembly 40, i.e., the end which mates with the end of the electrical contact module 34 shown in FIG. 5. When subassembly 40 is coupled with the electrical contact module 34, the second axial ends of both the lock case 112 and the lock core 114 extend into recess 84 of actuator 52. When actuating key 152 has turned the lock core 114 to one limit established by the stop washer 138, cam lobes 180 and 182 of the second cam member 140 will be located between the cam lobes 96 and 98 of the first cam member 46, and bias means 54 will operate to bias actuator 52 towards its first axial limit which will place the movable and stationary electrical contacts of the electrical contact module 34 in a first position. For example, the first position may place the two sets of contacts of the exemplary embodiment both in an open position, both in a closed position, or one in an open position and one in a closed position. The actuating key 152 may then be removed to lock the key switch 20 in this selected position. When it is desired to select the other position of the two-position key switch 20, the actuating key 152 is again inserted into the lock core 114 and it is turned to rotate the lock core 114 90 degrees to the other limit established by stop washer 138, which causes cam lobes 180 and 182 to engage cam lobes 96 and 98 to rectilinearly advance actuator 52 against the bias of the bias means 54 and change the positions of the stationary and movable electrical contacts. For example, if the electrical contacts were both open, they would now both be closed; if both of the electrical contacts were closed, both would now be open; and, if one of the electrical contacts was closed and the other was open, the open contact would now be closed and the closed contact will now be open.

In summary, there has been disclosed a new and improved two-position key switch which includes only three interchangeable modules, i.e., an electrical contact module, a halo module, and a lock module. The modules are selected and assembled for a specific application, and any one of the modules may be easily replaced if damaged or inoperative, or, in the event the application of the key switch has changed, the appropriate modules may be exchanged for new ones. First and second relatively simple cam members cooperate to translate rotary motion of the key controlled lock core to rectilinear motion of an actuator associated with the electrical contact module.

I claim as my invention:

1. A two-position key switch of modular construction, comprising:

an electrical contact module, a lock module, and a halo module, said electrical contact module including a housing, an actuator, a first cam member, actuator mounting means, and biasing means, said actuator having first and second axial ends, and a longitudinally extending recess which extends between said first and second ends, with the first axial end being open and with the second axial end being at least partially closed, said first cam member being disposed in the recess of said actuator, adjacent to the second axial end of said actuator, said actuator mounting means mounting said actuator in said housing for rectilinear motion along a predetermined longitudinal axis, between first and second axial limits, said biasing means being disposed to bias said actuator towards said first axial limit, said halo module including a cover, with said cover being mounted on the housing of said electrical contact module, said lock module including a rotatable element, a second cam member, and lock mounting means, said rotatable element having a first axial end adapted to receive an actuating key, and a second axial end, with said rotatable element being rotatable about a longitudinal axis which extends between said first and second axial ends, said second cam member being fixed to the second axial end of said rotatable element, said lock mounting means mounting said lock module in the cover of said halo module such that the second axial end of the rotatable element of said lock module extends through the open end of the recess in said actuator, to place said second cam member within said recess adjacent to said first cam member, such that said first and second cam members are engageable, said engageable first and second cam members being configured to cooperatively translate rotary motion of the rotatable element of said lock module to rectilinear motion of the actuator of said electrical contact module, to overcome the bias of said bias means and move the actuator towards the second axial limit.

2. The two-position key switch of claim 1 wherein the electrical contact module includes a first electrical contact fixed to the housing and a second electrical contact carried by the actuator, with said first and second electrical contacts being placed in first and second different positions relative to one another at the first and second axial limits, respectively, of the actuator.

3. The two-position key switch of claim 1 wherein the first and second cam members each have cam lobes which extend towards the first and second axial ends, respectively, of the actuator, with said cam lobes being engaged in a predetermined angular position of the rotatable element of the lock module, and disengaged in another predetermined angular position.

4. The key switch of claim 1 wherein the first cam member is dimensioned to be longitudinally slidable within the recess of the actuator, with the at least partially closed second end of the actuator providing a locating axial stop for the first cam member, and wherein the outer periphery of the first cam member and the surface of the actuator which defines the longitudinally extending recess are complementarily configured to orient the first cam member about the longitudinal axis of the actuator.

5. The two-position key switch of claim 1 including a stop washer carried by the rotatable element of the lock module which defines first and second angular rotational limits of the rotatable element of the lock module, with the first and second cam members being engaged at one of said rotational limits, and disengaged at the other of said rotational limits.

6. The two-position key switch of claim 5 wherein the halo module further includes a halo, and wherein the cover has first and second axial ends, with the first axial end being recessed, and wherein said halo is removably fixed in said recess of the cover.

7. The key switch of claim 6 including a panel having first and second sides, and an opening which extends therebetween, and means on the second side of said panel for mounting the halo module and electrical contact modules in assembled relation, and wherein the halo includes a protuberance which extends into the panel opening.

8. The key switch of claim 7 wherein the protuberance of the halo includes means identifying the first and second rotational limits of the rotatable element of the lock module.

* * * * *